United States Patent [19]

Ryan et al.

[11] Patent Number: 5,062,476

[45] Date of Patent: Nov. 5, 1991

[54] HEAT EXCHANGER WITH AN EXTRUDED TANK

[75] Inventors: Richard P. Ryan, East Amherst; Glenn W. Shaffer, Middleport; Gary A. Halstead, Lockport; David M. Smith, Amherst; Shrikant M. Joshi, Getzville, all of N.Y.

[73] Assignee: General Motors Corporation, Detroit, Mich.

[21] Appl. No.: 661,963

[22] Filed: Feb. 28, 1991

[51] Int. Cl.[5] ..... F28F 9/02

[52] U.S. Cl. ..... 165/173; 165/79; 165/149; 165/153

[58] Field of Search ..... 165/79, 153, 173, 149; 228/183; 29/890.052

[56] References Cited

U.S. PATENT DOCUMENTS

| | | | |
|---|---|---|---|
| 3,497,936 | 3/1970 | Donaldson | 29/890.052 X |
| 4,544,029 | 10/1985 | Cadars | 165/149 |
| 4,649,628 | 3/1987 | Allemandou | 165/148 |
| 4,707,905 | 11/1987 | Clair | 29/446 |
| 4,938,284 | 7/1990 | Howells | 165/149 |
| 5,009,262 | 4/1991 | Halstead et al. | 165/140 |

FOREIGN PATENT DOCUMENTS

| | | | |
|---|---|---|---|
| 112513 | 7/1984 | European Pat. Off. | 165/173 |
| 3222278 | 12/1983 | Fed. Rep. of Germany | 165/149 |
| 63-127094 | 5/1988 | Japan | 165/173 |
| 2049149 | 12/1980 | United Kingdom . | |

*Primary Examiner*—Allen J. Flanigan

*Attorney, Agent, or Firm*—Ronald L. Phillips

[57] ABSTRACT

A heat exchanger assembly has a pair of spaced extruded tanks and a tube and header subassembly including a pair of header plates on opposite ends of a plurality of spaced parallel tubes. The extruded tanks include stop surfaces thereon for locating the subassembly within the extruded tanks and the extruded tanks further include a pair of seal ribs and a pair of deformable side flanges defining a pocket for receiving flux material to secure the subassembly to the extruded tanks without exposing the flux material to the interior of the extruded tanks.

6 Claims, 1 Drawing Sheet

HEAT EXCHANGER WITH AN EXTRUDED TANK

FIELD OF THE INVENTION

This invention relates to heat exchangers with headers and more particularly to such heat exchangers having a plurality of spaced parallel tubes with convoluted metal air centers therebetween.

BACKGROUND OF THE INVENTION

Heat exchangers with stamped metal tanks have been connected to a subassembly comprising a pair of headers having a plurality of spaced, parallel flow tubes for directing fluid flow between the tanks. In such arrangements the tanks are provided with a surface which defines partitions within the tank to define a serpentine fluid flow path through the heat exchanger making it suitable for use in applications such as headered condensers for condensing high pressure refrigerant vapor circulating in an automotive air conditioning system.

In different applications, the tank shape and the number of refrigerant passes defined by the flow tubes depends upon several variables, including the height of the heat exchanger core, the width of the core, the depth of the core, and also on the refrigerant flow conditions and engine compartment packaging considerations.

Examples of sheet metal or pressed tanks for use on header heat exchangers are shown in U.S. Pat. No. 4,649,628 and 4,707,905 wherein the tank is secured to a header or tube end plate by a flanged end of the tube end plate.

Other heat exchangers are known in which an extruded member is used to form a automotive radiator. An example of such an extruded tank is set forth in UK Patent Application GB 2049149. In such arrangements parallel tube passes are directed through the extruded tank and are sealed relative thereto by resilient grommets.

In none of the aforesaid arrangements is provision made for a headered condenser design which is readily modified to accommodate a variety of applications without requiring a separate set of tools for forming different sized and shapes of stamped or extruded tank portion of the heat exchanger.

SUMMARY OF THE INVENTION

A feature of the present invention is to provide a headered condenser for use in automotive air conditioning systems having a tank component extruded by a single low cost tool and configured for a wide range of condenser applications.

A further feature of the present invention is to provide a headered condenser having its tank dimensions established by varying the length of an extrusion member connected to a tube and header subassembly at either end thereof and wherein the extrusion member includes integrally formed pockets for containing flux material for brazing the tube and header subassembly to the tank without exposing the interior of the tank to the flux material thereby preventing the flux material from entering a refrigerant flow passing through the headered condenser.

Another feature of the present invention is to provide a headered condenser whose core dimensions can be varied by varying the length of an extruded tank member having means thereon forming a stop for controlling the depth of tube insertion within the tank thereby to reduce refrigerant flow pressure drop.

Still another feature of the invention is to provide a headered condenser in which a pair of extruded tanks are configured with an open tank chamber for receiving the ends of parallel tubes in a tube and header subassembly to provide a maximized condenser width without increasing the width of the condenser between tank surfaces thereof.

Yet another feature of the present invention is to provide an H-shaped extruded member forming a tank in a headered condenser having bracket support tabs on one end thereof and forming an open ended tank chamber on the opposite end thereof which receives and is brazed to a parallel tube and header subassembly.

Still another object of the invention is to provide a heat exchanger assembly having a pair of spaced unitary members; each of the unitary members having tank portions; a plurality of tube members extending between the unitary members for communicating each of the tank portions in fluid flow relationship; each of the tube members having opposite end surfaces thereon and header members engaged to said tube members for sealing against fluid leakage along the opposite end surfaces and for locating the tube members in spaced relationship to one another lengthwise of the unitary members; the header members having an inboard surface and an outboard surface; and the unitary members each having a pair of seal ribs thereon engaged with the inboard surface for sealing against fluid leakage from the tank portions; and integral tabs on the unitary members bent against the outboard surfaces to hold the header members in sealed engagement with the inboard surfaces.

These and other objects, advantages and features of the present invention will become more apparent from the following description when taken in conjunction with the drawings in which:

DESCRIPTION OF A PREFERRED EMBODIMENT OF THE INVENTION

Figure 1:
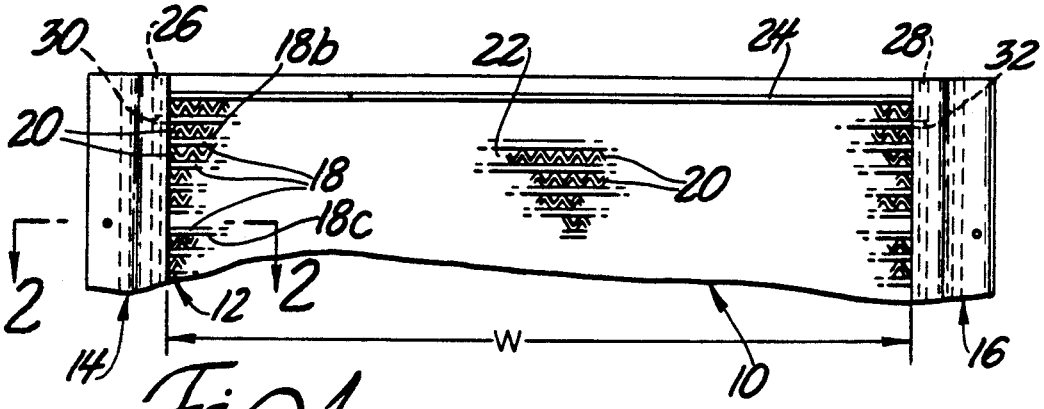
FIG. 1 is a fragmentary front elevational view of a heat exchanger including the present invention.
Figure 2:
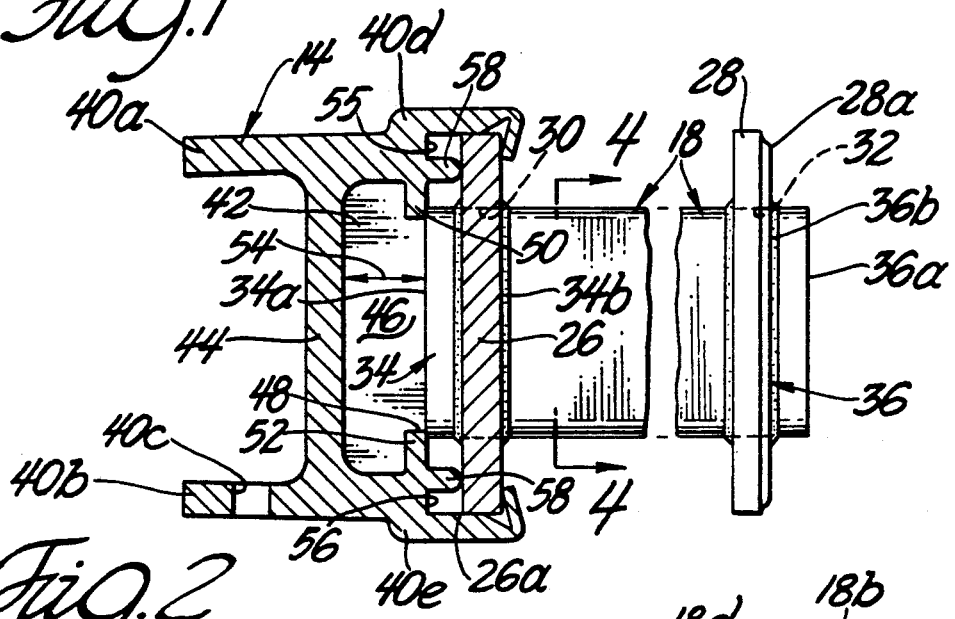
FIG. 2 is an enlarged cross sectional view, partially in elevation, taken along the line 2–2 in FIG. 1 looking in the direction of the arrows.

Referring now to FIG. 1, a heat exchanger 10 is illustrated including a header and tube subassembly 12 connected between a pair of fluid tanks 14, 16 including the present invention.

Figure 4:
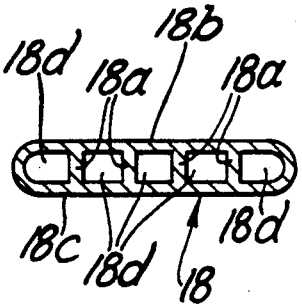
FIG. 4 is a sectional view taken along the line 4–4 of FIG. 2 looking in the direction of the arrows.

More particularly, the header and tube subassembly 12 includes a plurality of flat tubes 18 arranged in spaced parallelism as best seen in FIG. 1. Each of the flat tubes 18 has a plurality of reinforcing ribs **18*a* as shown in FIG. 4. The tube passes 18 further include surfaces 18*b* and 18*c* which are in conductive heat transfer relation with an air center 20 located within an air flow space 22 formed between each of the tube passes 18 and the upper and lower tube passes 18 and a top reinforcing member 24 and a like bottom reinforcing member (not shown). Each of the air centers 20 is comprised of a thin metal strip convoluted along its length to form an extended surface for exchange of heat between air flow across the air centers and another fluid passing through the openings 18***d* formed between the reinforcing ribs 18*a* of each of the flat tubes 18.

The header and tube subassembly 12 further includes a header plate 26, 28 with spaced slot openings 30, 32 respectively to receive the outer ends 34, 36 of each of the tubes 18 at a point inboard of the distal ends 34*a*, 36*a* thereof. The slot openings 30, 32 are arranged to space the tube passes 18 to define the air flow spaces 22 in which the air centers 20 are located. The outer ends 34, 36 have peripheral surfaces 34*b*, 36*b* thereon brazed to the header plates 26, 28 at the slot openings 30, 32 therethrough to seal them against fluid leakage from the pair of fluid tanks 14, 16.

The header plates 26, 28 are made of sheet metal material and each have transverse ribs 26*a*, 28*a* formed therein between the slot openings 30, 32 to improve the structural strength of the headers.

Figure 3:
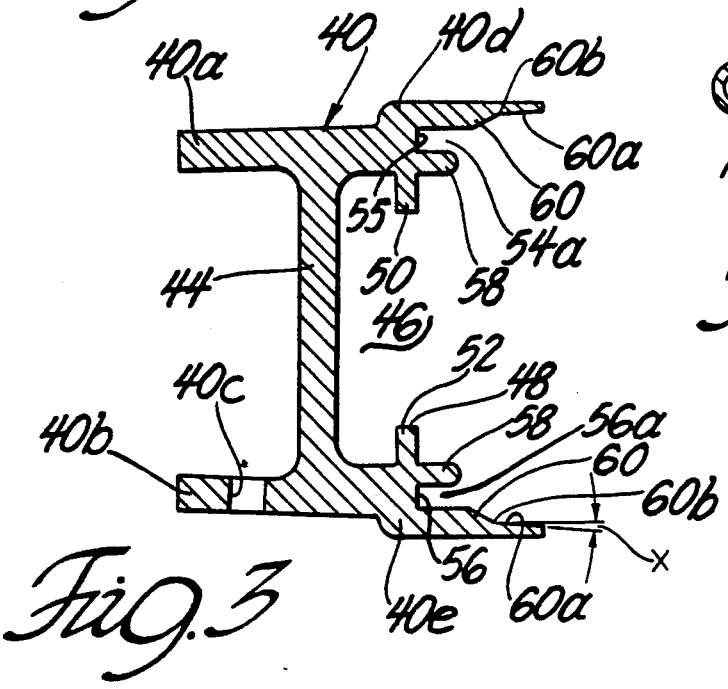
FIG. 3 is an enlarged sectional view of a tank member prior to connection to a tube and header subassembly of the present invention.

In accordance with one aspect of the present invention the fluid tanks 14, 16 are formed as unitary members from a single extrusion die having a die opening therein of generally H-section. Metal material compatible with the header plates and tubes is forced through the die opening to form an extruded member 40 having the configuration shown in FIG. 3. The height of the heat exchanger 10 is established by cutting the extruded member 40 to a length in which a desired number of tube passes can be arranged. The invention has particular application to condensers for use in cooling high pressure refrigerant vapor in the refrigerant circuit of a motor vehicle air conditioning system. In such condenser, the optimum number of tube passes for cooling refrigerant is a function of several variables including the core height, the core width, the pitch and height of the air centers, refrigerant flow, packaging constraints, etc. In the past tanks for such condensers were stamped from tooling which was special for each condenser design.

Tooling for such stamped tanks can cost in excess of six figures U.S. dollars and the operational cost and die change expense for such tooling is also considerable. The use of a single extrusion die is usually a few thousand dollars and the size of the core of a condenser can be varied merely by changing the length of the extruded member 40. Furthermore, as will be discussed the extruded member 40 is configured to enable separators 42 to be positioned anywhere along the length of the tanks 14, 16 to provide a tube pass arrangement necessary to optimize performance in a given core design. While especially suited for use in the optimization of condensers for automotive air conditioning systems the present invention is equally suited for use in other heat exchanger types having headered tube passes.

To accomplish the objectives of the present invention, the extruded member 40 has an H-shaped cross-section as shown in FIG. 4. The H-shape includes a bight portion 44 defining the back wall of a fluid chamber 46 open ended at 48. The H-shaped cross-section is formed in part by a pair of spaced side legs or flanges 40*a*, 40*b* that extend from one side of the bight portion 44. The side flanges 40*a*, 40*b* can be formed to have attachment openings therein as shown at 40*c* in flange 40*b*. The side flanges 40*a*, 40*b* are optional and can be omitted in cases where other forms of attachment are available.

The H-shaped cross-section also has a pair of spaced side legs or flanges 40*d*, 40*e* on the opposite side of the bight portion 44 which cooperate therewith to form the fluid chamber 46. A pair of stop tabs 50, 52 are formed inboard of the extruded member 40. They are arranged to engage the distal ends 34*a*, 36*a* of each of the tube passes 18 to prevent excessive tube insertion within the fluid chambers 46 thereby to provide a clearance space 54 between the tube passes and the bight portion 44. As a consequence, fluid refrigerant or other fluid is able to flow without restriction in the chamber 46 for flow therefrom through suitable fittings on the tanks 14, 16 (not shown) which will connect the heat exchanger 10 to a system for flowing a fluid through the tube passes for transfer of heat with respect to air flow through the air centers 20. The elimination of such flow restriction will thereby prevent excessive pressure drop on the refrigerant side of the heat exchanger 10 so as to eliminate performance penalties otherwise associated with increased pressure drop.

Another feature of the invention is the provision of side channels 55, 56 integrally formed in the extruded member 40. The side channels 54, 56 are formed on one side by a seal rib 58 and on the other side thereof by a flange extension 60 whereby the side channels 55, 56 form pockets 54*a*, 56*a* for flux material to braze the header plates 26, 28 to the tanks 14, 16, respectively to seal the subassembly 12 internally of the tanks 14, 16 without exposing fluid in the chamber 46 to the flux material in the pockets 54*a*, 56*a*.

The flange extensions 60 have a draft angle on the inner surfaces 60*a* thereof which will enable the tanks 14, 16 to be readily connected to the subassembly 12. Once the tube ends 34*a*, 36*a* are seated against the stop tabs 50, 52 the headers 26, 28 are fastened in place by folding the extensions 60 against the outer surfaces 26*b*, 28*b* of the headers by bending the extensions 60 about a hinge point 60*b* in the inner surfaces 60*a*.

The advantages of the extruded tanks 14, 16 is that the extrusion is lighter and cheaper than prior headered tube condenser assemblies. The cross-section of each of the tanks 14, 16 can be configured with non-uniform wall thickness to provide additional material in regions of higher stress while reducing material where added strength is not required. The use of an extrusion eliminates stamping scraps and waste. Furthermore, another advantage of the invention is that the extruded tank improves the condenser package by increasing the effective condenser width by enclosing part of the tube length with the tank and using the tank flanges 40*d*, 40*e* to connect the tanks 14, 16 to the tube and header subassembly 12. The tanks 14, 16 and subassembly 12 provide an increased effective condenser width W that is not blocked by the use of external connectors thereby to enable a greater amount of ram air flow to pass through the frontal area of the heat exchanger so as to improve condenser performance.

A further advantage is that the header does not require bracket support tabs thereon. Such bracket supports are provided by the flanges 40*a*, 40*b* in which mounting holes can be drilled at any point on the height of the heat exchanger 10 to meet any customer requirement for mounting the heat exchanger without requiring special tooling and additional tool costs attendant thereto for forming special bracket supports.

While the above construction is preferred, it will be appreciated, of course the dimensions of the fastening brackets can be made asymmetrical to those of the tank forming members. Furthermore, the use of slotted headers can be modified to accommodate circular holed headers in which case the tube passes will be modified to a circular shape rather than the flat tube shape illustrated herein.

The above described preferred embodiments are thus illustrative of the invention which may be modified within the scope of the appended claims.

What is claimed is:

1. A heat exchanger assembly having a pair of spaced unitary members;

each of said unitary members having tank means;

a plurality of tube members extending between said unitary members for communicating each of said tank means in fluid flow relationship;

each of said tube members having opposite end surfaces thereon;

header means engaged to said tube members for sealing against fluid leakage along said opposite end surfaces and for locating said tube members in spaced relationship to one another lengthwise of said unitary members; said header means having an inboard surface and an outboard surface;

said unitary members each having a pair of seal ribs thereon engaged with said inboard surface for sealing against fluid leakage from said tank means;

and integral tab means on said unitary members bent against said outboard surface to join said header means to said unitary members.

2. A heat exchanger assembly having a pair of spaced unitary members;

each of said unitary members having an H-shape with a bight wall formed midway thereof; mounting means on one side of said bight wall and tank means on the other side of said bight wall;

a plurality of tube members extending between said unitary members for communicating each of said tank means in fluid flow relationship;

each of said tube members having opposite end surfaces thereon;

header means engaged to said tube members for sealing against fluid leakage along said opposite end surfaces and for locating said tube members in spaced relationship to one another lengthwise of said unitary members; said header means having an inboard surface and an outboard surface;

said unitary members each having a stop surface thereon engageable with said tube members for locating said tube ends in spaced relationship to said bight wall;

a pair of seal ribs on each of said unitary members engaged with said inboard surfaces for sealing against fluid leakage from said tank means; and integral tab means on said unitary members bent against said outboard surface to join said header means to said unitary members.

3. A heat exchanger assembly having a pair of spaced extruded unitary members having continuous extruded surfaces lengthwise thereof;

each of said extruded unitary members having tank means; said tank means having three integral wall segments forming an open ended cavity;

a plurality of tube members extending between said extruded unitary members for communicating each of said open ended cavities in fluid flow relationship;

each of said plurality of tube members having opposite end surfaces thereon;

header means engaged with said tube members for sealing against fluid leakage along said opposite end surfaces and for locating said tube members in spaced relationship to one another lengthwise of said extruded unitary members; said header means having an inboard surface and an outboard surface;

said extruded unitary members each having a pair of seal ribs thereon formed continuously lengthwise of said unitary member; said seal ribs engaged with said inboard surface for sealing against fluid leakage from said open ended cavity;

and integral tab means on said unitary members bent against said outboard surface to join said header means to said extruded unitary members.

4. A heat exchanger assembly having a pair of spaced extruded unitary members having an H-shape with a bight wall and H-legs on either side thereof;

each of said extruded unitary members having fastener means in the H-legs on one side of said bight wall and tank means in the H-legs on the other side of said bight wall;

a plurality of tube members extending between said extruded unitary members for communicating each of said tank means in fluid flow relationship;

each of said tube members having opposite end surfaces thereon;

said extruded unitary members each having a stop surface thereon engageable with said tube members for locating said tube ends in spaced relationship to said bight wall;

header means engaged to said tube members for sealing against fluid leakage along said opposite end surfaces and for locating said tube members in spaced relationship to one another lengthwise of said extruded unitary members;

said header means having an inboard surface and an outboard surface;

and said extruded unitary members each having a pair of seal ribs thereon engaged with said inboard surface for sealing against fluid leakage from said tank means;

and integral tab means on said extruded unitary members bent against said outboard surface to join said header means to said extruded unitary members.

5. A heat exchanger assembly having a pair of spaced extruded unitary members having continuous extruded surfaces lengthwise thereof forming an H-section having a bight wall and H-legs on either side thereof;

each of said extruded unitary members having tank means including H-legs on one side of said bight wall for forming an open ended cavity;

a plurality of tube members extending between said extruded unitary members for communicating each of said open ended cavities in fluid flow relationship;

each of said tube members having opposite end surfaces thereon;

header means engaged to said tube members for sealing against fluid leakage along said opposite end surfaces and for locating said tube members in spaced relationship to one another lengthwise of said extruded unitary members; said header means having an inboard surface and an outboard surface;

said extruded unitary members each having a pair of seal ribs thereon formed continuously lengthwise of said unitary member;

pocket means including said seal ribs engaged with said inboard surface for forming a sealed tank at each end of said tube members and for sealing against fluid leakage from said open ended cavity; said pocket means having flux material for bonding said inboard surface to said extruded unitary member; said pocket means preventing said flux material from entering said open end cavity;

and integral tab means on said unitary members bent against said outboard surface to join said header means to said extruded unitary members.

6. A heat exchanger assembly having a pair of spaced unitary members;

each of said unitary members having tank means;

a plurality of tube members extending between said unitary members for communicating each of said tank means in fluid flow relationship;

each of said tube members having opposite end surfaces thereon;

header means engaged to said tube members for sealing against fluid leakage along said opposite end surfaces and for locating said tube members in spaced relationship to one another lengthwise of said unitary members; said header means having an inboard surface and an outboard surface;

and said unitary members each having a pair of pockets for containing flux material to bond said unitary members to said inboard surface for sealing against fluid leakage from said tank means and said pair of pockets being configured to prevent the entry of flux from said pockets into fluid within said tank means; and integral tab means on said unitary members bent against said outboard surface to join said header means to said unitary members.

* * * * *